US006349875B1

(12) United States Patent
Whitnell

(10) Patent No.: US 6,349,875 B1
(45) Date of Patent: Feb. 26, 2002

(54) CONTAINER HAVING AN IMPROVED HINGE

(75) Inventor: Simon Whitnell, Media, PA (US)

(73) Assignee: Dopaco, Inc., Exton, PA (US)

( * ) Notice: Subject to any disclaimer, the term of this patent is extended or adjusted under 35 U.S.C. 154(b) by 0 days.

(21) Appl. No.: 09/641,131

(22) Filed: Aug. 16, 2000

(51) Int. Cl.[7] ..... B65D 5/20; B65D 5/42

(52) U.S. Cl. ..... 229/146; 229/114; 229/160.1; 229/931

(58) Field of Search ..... 229/114, 146, 229/160.1, 920, 930, 931; 220/837, 839

(56) References Cited

U.S. PATENT DOCUMENTS

| | | | | | |
|---|---|---|---|---|---|
| 1,839,752 | A | * | 1/1932 | Fogg | 229/931 |
| 4,266,713 | A | * | 5/1981 | Maroszek | 229/114 |
| 4,360,147 | A | * | 11/1982 | Brauner | 229/146 |
| 4,559,259 | A | | 12/1985 | Cetrelli | |
| 4,792,085 | A | | 12/1988 | Waring, III et al. | |
| RE33,979 | E | * | 6/1992 | Cortopassi | 229/114 |
| 5,205,476 | A | * | 4/1993 | Sorenson | 229/114 |
| 5,221,040 | A | | 6/1993 | Sorenson | |
| 5,332,147 | A | | 7/1994 | Sorenson | |
| 5,388,758 | A | | 2/1995 | Scovell | |
| 5,875,960 | A | * | 3/1999 | Nanno | 229/146 |

* cited by examiner

*Primary Examiner*—Gary E. Elkins
(74) *Attorney, Agent, or Firm*—Dennison, Scheiner & Schultz

(57) ABSTRACT

A clamshell container having an improved hinge for reducing container rear wall buckling when the container is opened and closed is disclosed. The hinge includes first and second offset partial hinge portions, each extending inwardly from one side of the container for less than the full width of the container. The partial hinge portions include fold line portions near the container side walls and parallel slit portions in the central area of the rear wall. A blank for forming the subject container is also disclosed.

19 Claims, 3 Drawing Sheets

CONTAINER HAVING AN IMPROVED HINGE

FIELD OF THE INVENTION

The subject invention is directed toward a container having an improved hinge, and more particularly toward a clamshell container formed from a flexible material having a hinge which operates smoothly and without buckling.

BACKGROUND OF THE INVENTION

Clamshell containers are widely used in the fast food industry. These containers are often formed from a flexible material such as paperboard, and are sturdy enough to protect food products being carried off the restaurant premises for consumption elsewhere. They are also adequately inexpensive that they can be used as serving containers for eat-in customers. Such containers are generally manufactured and shipped in an open configuration, filled with a food product by a restaurant employee, and then closed and given to a consumer. The consumer opens the container to gain access to the product can close the container if necessary to save the food for later.

Clamshell containers comprise a tray portion and a lid portion connected to the tray portion by a hinge on the rear wall of the container. In known containers, the hinge is typically a fold line which allows the paperboard material of the container to fold when the lid is opened. However, this arrangement often causes the rear wall of the container to buckle when the container is opened or closed. This occurs because the rear wall of the container is often slightly bowed, especially when a food product is placed in the container. Therefore, the fold line is not linear, and this non-linear fold line does not fold easily. The rear wall of the container must be deformed considerably when opening a typical container, and this makes the container awkward to use.

Numerous attempts have been made to address this problem. For example, U.S. Pat. No. 5,388,758 to Scovell and U.S. Pat. No. 4,792,085 to Waring use a plurality of cut lines around the center of the hinge or fold line to allow the back wall to buckle more readily. These arrangements reduce the problems caused by the buckling of the back wall, but do not address the problem directly.

U.S. Pat. No. 5,332,147 to Sorenson addresses the problem by providing a slit along the fold line of the hinge and by providing at least one additional slit spaced above or below the hinge fold line. These slit allow a localized bending that relieves stress on the rear wall and reduces rear wall buckling. While Sorenson shows the promise of using a stress relief approach to reducing buckling, the structure taught by this reference does not completely eliminate the problem of buckling.

It would therefore be desirable to provide an improved clamshell container having a hinge that absorbs stresses imparted to the container rear wall when the lid is moved between open and closed positions and that substantially prevents the buckling of the container rear wall.

SUMMARY OF THE INVENTION

This problem is addressed by the present invention by providing a clamshell container with an improved hinge that does not lie along a single fold line. Instead, the hinge of the present invention includes a first partial hinge portion extending inwardly from a first side of the container and a second partial hinge portion extending inwardly from the second side of the container, which portions are not collinear.

In a preferred embodiment, the first hinge portion comprises a first fold line or line of weakness extending inwardly from a first edge of the container for a short distance and a first slit that extends inwardly from the end of the first fold line to a point spaced apart from the second side wall of the container. The wall portion between the second end of the first slit and the second wall is not scored or otherwise weakened and thus will resist bending when the container is opened. The second hinge portion is substantially identical to the first hinge portion, but extends inwardly from the second side of the container so that the slits are disposed in a parallel and spaced-apart relationship.

This arrangement provides a flexible strip defined by the first and second spaced apart slits, which strip twists where the container is opened or closed. The stresses that would normally be distributed across the rear wall of the container are instead localized along this strip. Twisting the narrow strip requires little effort, and thus the strip twists and relieves stress while deforming in a manner that is hardly noticeable to a user. Significantly, the presence of a single fold line at opposite ends of the two strips creates offset regions where folding can take place. These offset regions and the offset fold lines allow the lid of the container to pivot slightly during opening and absorb some of the force that otherwise would have buckled the rear wall of a container without this hinge arrangement.

A blank for forming a container according to the invention is also disclosed.

It is therefore a principal object of the present invention to provide a container having a stress-relieving hinge.

It is another object of the present invention to provide a clamshell container with a rear wall that does not buckle when the container is opened and closed.

It is a further object of the present invention to provide a container hinge having first and second offset partial hinge portions.

It is still another object of the present invention to provide an arrangement of fold lines and slits in the rear wall of a clamshell container to minimize buckling when the container is opened and closed.

It is still a further object of the present invention to provide a blank for forming an anti-buckle clamshell container.

BRIEF DESCRIPTION OF THE DRAWINGS

These and other objects of the invention will be better appreciated after a reading of the detailed description of a preferred embodiment of the invention and the following drawings wherein.

DETAILED DESCRIPTION OF A PREFERRED EMBODIMENT

Figure 1:
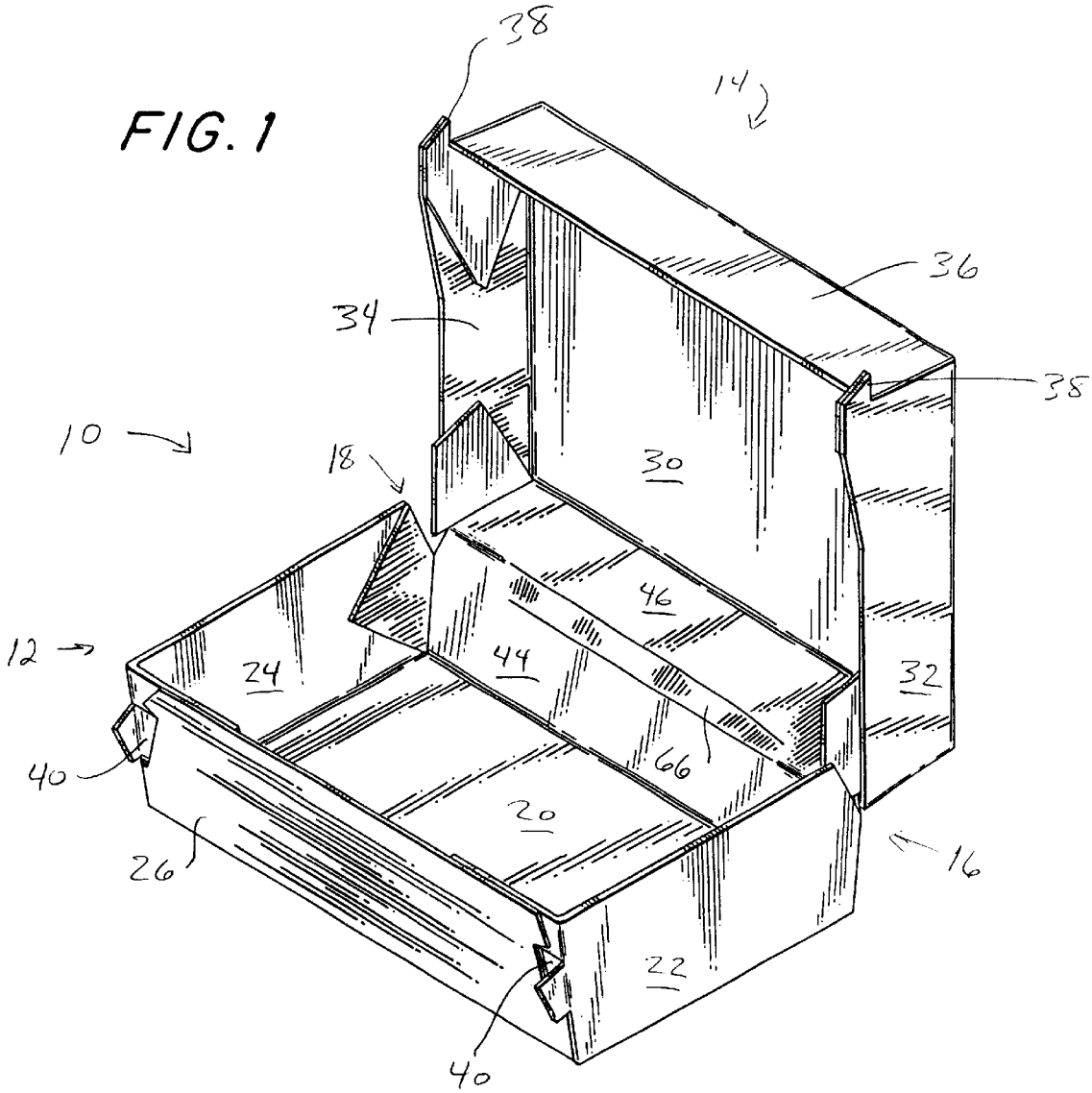
FIG. 1 is a front perspective view of a container having a hinge according to the present invention with the lid of the container raised to a vertical position.

Referring now to the drawings, wherein the showings are for purposes of illustrating a preferred embodiment of the subject invention only, and not for the purpose of limiting same, FIG. 1 shows a clamshell container 10 formed from a single sheet of paperboard material and comprising a lower or tray portion 12 and a lid or cover portion 14, and having a first side 16 and a second side 18. Tray 12 includes a bottom wall 20, a first side wall 22 on first side 16 of the container, a second side wall 24 on second side 18 of the container, and a front wall 26 extending from bottom wall 20 between the first and second side walls. Lid 14 comprises a top wall 30, a first side wall 32 along the first side 16 of the container, a second side wall 34 along second side 18 of the container and a front wall 36 depending from top wall 30 and connecting the first and second side walls. Lid front wall 36 includes two tabs 38 which engage slots 40 in tray front wall 26 to lock the lid in place after the container has been filled; other locking arrangements could be also be used in place of this particular arrangement.

Figure 2:
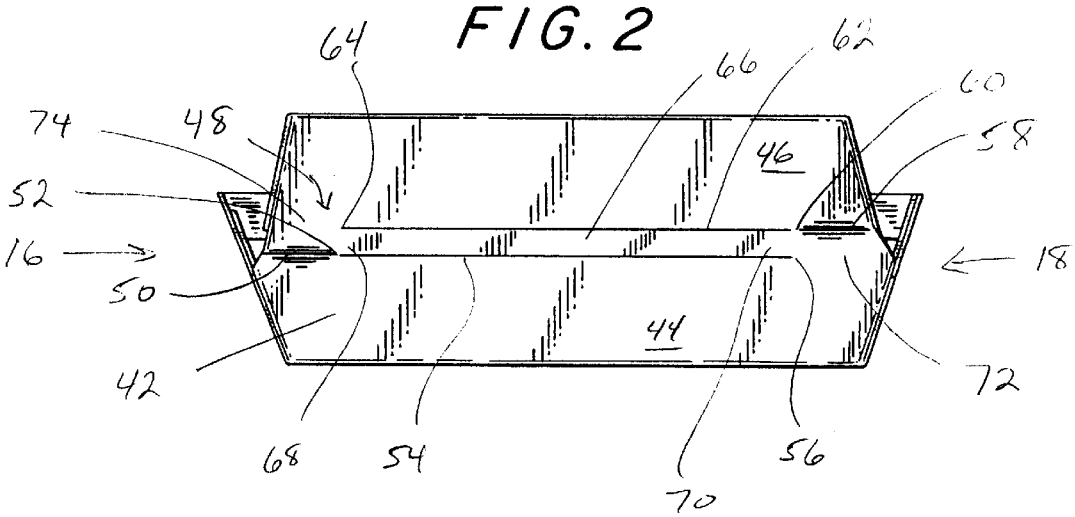
FIG. 2 is a rear elevation view of the subject container with the lid closed.

As seen in FIG. 2, a continuous back wall 42 extends from tray bottom wall 20 to lid top wall 30 and between the first and second side walls of the tray and lid. Back wall 42 has a lower panel portion 44, an upper panel portion 46 and a hinge portion 48 located between the upper and lower panel portions.

In order to make the formed, open clamshell container stackable, the tray side walls, front wall and lower portion of the rear wall are all angled slightly outwardly from tray bottom wall; furthermore, the lid side walls, front wall and upper portion of the back wall are all angled slightly outwardly from the tray top wall. Thus, the periphery of the clamshell container around its mid-portion is greater than the periphery of either the top or bottom walls of the container.

The clamshell container described above is generally similar to know containers. In known containers, however, the hinge on the rear wall would comprise a fold line or other line of weakness running between the first and second sides of the container to allow the lid to pivot between open and closed positions with respect to the tray. This arrangement is not always satisfactory for the reasons describe above. Specifically, it has been found that the rear walls of clamshell containers constructed with a hinge line often buckle when the lid is shifted between open and closed configurations, and that this buckling can make the container difficult to use. The configuration of hinge region 48, described below, substantially eliminates this buckling problem.

Figure 3:
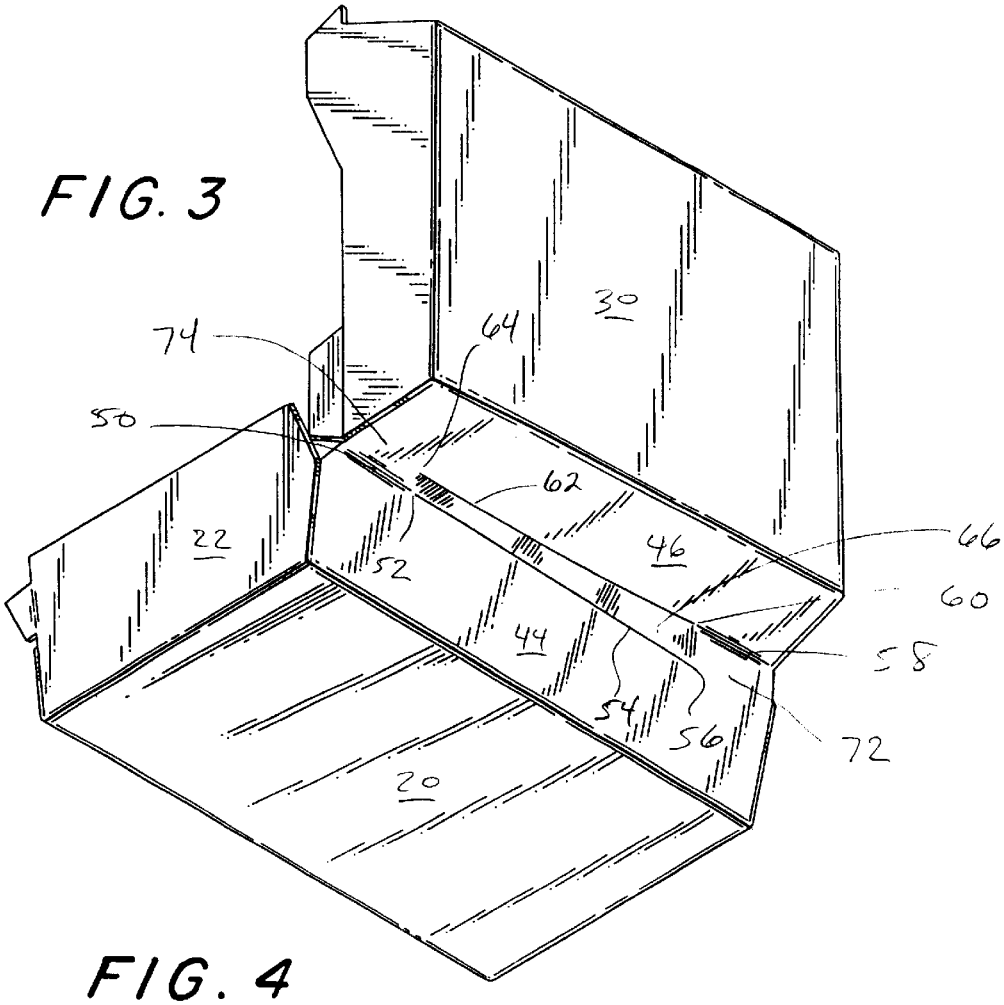
FIG. 3 is a rear perspective view of the container shown in FIG. 1.

As best seen in FIG. 2, hinge region 48 comprises a first fold line 50 extending inwardly from the first side 16 of the container to a point 52 in the direction of second side 18, a slit 54 extending from point 52 to a second point 56 closer to the second side 18 of the container than point 52, a second fold line 58 running inwardly from second side 18 to a third point 60 in the direction of first side 16, and a slit 62 extending from third point 60 to a fourth point 64 between point 60 and first side 16. Slits 54 and 62 are generally parallel and define between them a strip 66 having a first end 68 and a second end 70. Significantly, the region of rear wall 72 between second point 56 and second side wall 18 and the region 74 between fourth point 64 and first side 16 are not creased or perforated and thus offer no defined line of weakness to fold when the container lid is moved relative to the base. These regions resist folding and thus cause the lid to pivot slightly when it opens on this offset hinge, as seen in FIG. 3.

Figure 4:
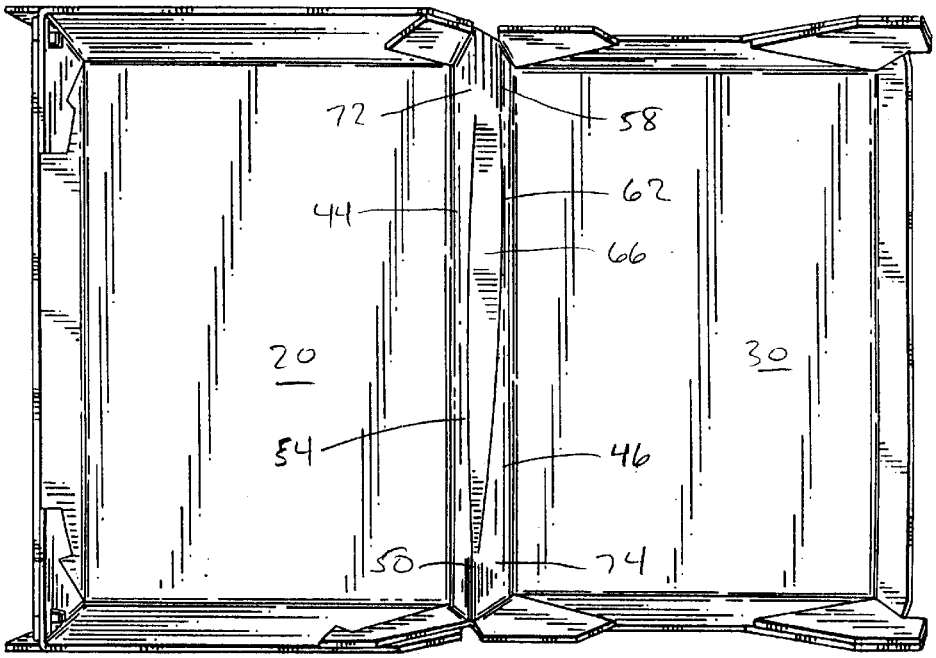
FIG. 4 is a top plan view of the subject container with the lid fully opened and extending horizontally from the container bottom; and, FIG. 5 is a blank for forming the container of the foregoing figures.

In the closed configuration shown in FIG. 2, strip 66 is generally coplanar with rear wall upper panel portion 46. However, as can be seen in FIGS. 3 and 4, strip 66 twists when lid 14 is moved to the vertical orientation shown in FIG. 3 twists even further when the lid is positioned with to wall 30 generally on the same plane as the surface supporting bottom wall 20. This twist occurs in part because of the existence of offset fold lines 50, 58 and offset uncreased regions 72, 74. In use, as lid 14 begins to pivot from the closed to an open position, first and second fold lines 50, 58 offer little resistance to movement and act in a manner similar to ordinary fold line hinges. However regions 72 and 74 lack any lines of weakness and thus resist bending when the lid is opened. These regions do not bend, but help cause strip 66 to twist as the lid is opened. Strip 66 absorbs the forces that would otherwise have been distributed across the entire rear wall of the container and caused the rear wall to buckle. This arrangement also allow the carton to return to a closed position without any appreciable rear wall buckling.

Figure 5:
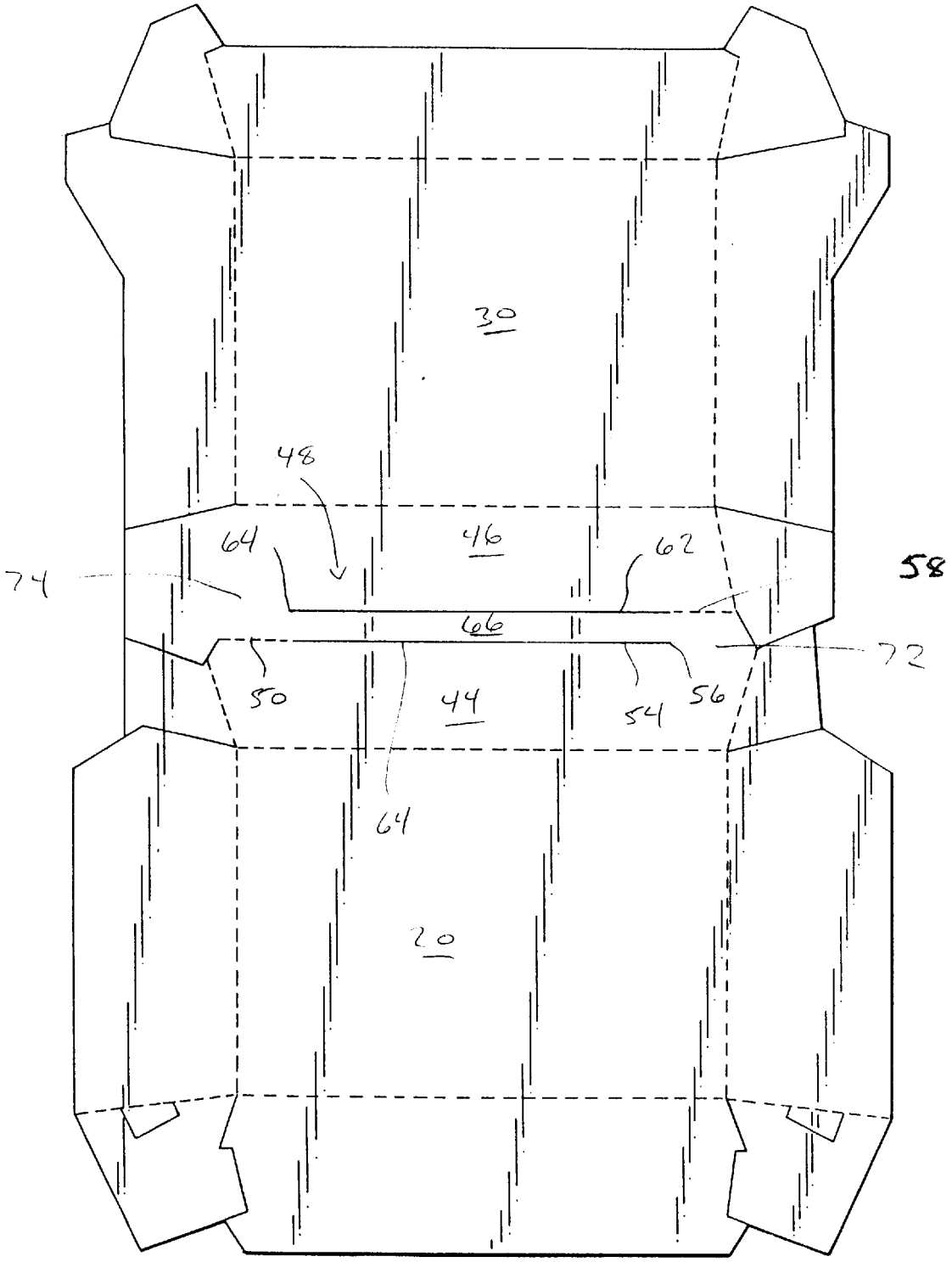

FIG. 5 shows a blank 80 for forming the clamshell described above.

The present invention has been described in terms of a preferred embodiment; however, obvious modifications and additions to this embodiment will become apparent to those skilled in the art upon a reading and understanding of the foregoing description. For example, while the buckling problem is often noticed in clamshell containers, the subject hinge could be used equally well in connection with other containers. Furthermore, while the invention has been described in terms of clamshell containers used in the food industry, the product inside the container does not change the nature of the claimed hinge arrangement. It is intended that all such variations and modifications form a part of this invention to the extent that they are included within the scope of the several claims appended hereto.

I claim:

1. A clamshell container comprising a first side and a second side;

a base having a bottom wall;

a lid having a top wall;

a rear wall extending between said bottom wall and said top wall;

a first fold line on said rear wall extending inwardly for a first distance from said first side to an inner end;

a second fold line on said rear wall extending inwardly for a second distance from said second side to an inner end;

a first cut extending inwardly from said first fold line inner end toward said second side;

a second cut extending inwardly from said second fold line inner end toward said first side;

wherein said first fold line is spaced apart from said base by a third distance and said second fold line is spaced apart from said base by a fourth distance greater than said third distance.

2. The container of claim 1 wherein said first cut is parallel to said second cut.

3. The container of claim 1 wherein said first cut is longer than said first fold line.

4. The container of claim 1 wherein said first cut and said second cut define a rectangular strip twistable with respect to one plane of the rear wall.

5. The container of claim 1 wherein said rear wall comprises a flexible paperboard material, said first cut includes a second end spaced apart from said cut first end, and a section of uncreased paperboard material separates said second end from said second side.

6. The container of 5 wherein said second cut includes a second end spaced apart from said second cut first end and said rear wall includes a second section of uncreased paperboard material between said second cut second end and said first side.

7. An integral hinged panel having a first and a second side and a width between said first side and second side comprising a top hinge panel;

a bottom hinge panel;

a hinge region connecting said top panel and said bottom panel, said hinge region comprising a first fold line extending from said first side toward said second side and a second fold line non-collinear with said first fold line and extending from said second side toward said first side, the length of said first fold line being less than the width of said panel.

8. The panel of claim 7 further including a first slit extending from said first fold line.

9. The panel of claim 8 including a second slit extending from said second fold line.

10. The panel of claim 9 wherein said first slit and said second slit are parallel.

11. The panel of claim 9 wherein said first slit extends from said first fold line to a point spaced apart from said second side.

12. An integral hinged panel having a first side and a second side comprising a first panel portion and a second panel portion connected by a hinge, wherein said hinge comprises:

a first partial hinge extending from said first side toward said second side to a point spaced away from said second side; and, a second partial hinge parallel to said first partial hinge and extending from said second side toward said first side to a point spaced away from said first side.

13. The panel of claim 12 wherein said first partial hinge comprises a fold line.

14. The panel of claim 12 wherein said first partial hinge comprises a slit.

15. The panel of claim 12 wherein said first partial hinge comprises a fold line extending from said first side to a first point and a slit extending from said first point to said point spaced apart from said second side.

16. The panel of claim 15 wherein said second partial hinge comprises a fold line extending from said second side to a third point and a slit extending from said third point to said point spaced apart from said first side.

17. The panel of claim 12 wherein said panel has a centerline and said first hinge and second hinge are spaced on opposite sides of said centerline.

18. A blank for forming a clamshell container comprising:

a first side and a second side;

a first end panel extending between said first side and said second side and having a first edge;

a second end panel extending between said first side and said second side and having a first edge;

a central panel extending between said first side and said second side and between said first end panel first edge and said second end panel first edge;

said central panel including first and second cuts parallel to each other and to said first end panel first edge; and, a first fold line extending from a first end of said first cut to said first end panel first edge.

19. The blank of claim 18 wherein said first cut includes a second end and wherein an uncreased portion of blank material is located between said second end and said second side.

* * * * *